US009638215B2

(12) United States Patent
Burgess

(10) Patent No.: US 9,638,215 B2
(45) Date of Patent: May 2, 2017

(54) WELL FLUID EXTRACTION JET PUMP PROVIDING ACCESS THROUGH AND BELOW PACKER

(71) Applicant: Steve Burgess, Shreveport, LA (US)

(72) Inventor: Steve Burgess, Shreveport, LA (US)

( * ) Notice: Subject to any disclaimer, the term of this patent is extended or adjusted under 35 U.S.C. 154(b) by 445 days.

(21) Appl. No.: 13/771,347

(22) Filed: Feb. 20, 2013

(65) Prior Publication Data

US 2014/0234127 A1 Aug. 21, 2014

(51) Int. Cl.
*F04F 5/54* (2006.01)
*F04F 5/46* (2006.01)
*F04F 5/10* (2006.01)

(52) U.S. Cl.
CPC ..... *F04F 5/54* (2013.01); *F04F 5/10* (2013.01); *F04F 5/46* (2013.01)

(58) Field of Classification Search
CPC ..... F04F 5/10; F04F 5/46; F04F 5/54; E21B 43/121; E21B 43/124
USPC ..... 417/108, 163, 170, 174, 184; 166/68, 166/105
See application file for complete search history.

(56) References Cited

U.S. PATENT DOCUMENTS

| | | | |
|---|---|---|---|
| 1,258,418 | A | 3/1918 | Kemble |
| 1,693,101 | A | 11/1928 | Worthington |
| 1,758,376 | A | 5/1930 | Sawyer |
| 2,080,623 | A | 5/1937 | McMahon |
| 2,114,905 | A | 4/1938 | McMahon |
| 2,291,911 | A | 8/1942 | McMahon |
| 2,468,642 | A | 4/1949 | Shallenberg |
| 2,489,636 | A | 11/1949 | Gurley |
| 2,812,723 | A | 11/1957 | Coberly |
| 3,551,074 | A | 12/1970 | Stout |
| 4,135,861 | A | 1/1979 | Brown et al. |
| 4,280,662 | A | 7/1981 | Erickson et al. |
| 4,285,638 | A | 8/1981 | Clark |
| 4,310,288 | A | 1/1982 | Erickson |
| 4,504,195 | A | 3/1985 | Binks et al. |
| 4,505,646 | A | 3/1985 | Long et al. |
| 4,603,735 | A | 8/1986 | Black |
| 4,605,069 | A | 8/1986 | McClaflin et al. |
| 4,658,893 | A | 4/1987 | Black |

(Continued)

*Primary Examiner* — William H Rodriguez
*Assistant Examiner* — Christopher Brunjes
(74) *Attorney, Agent, or Firm* — R. Keith Harrison

(57) ABSTRACT

A through-accessible reversible operation jet pump for attachment to a tubing string includes a pump housing having a pump housing interior and a jet pump assembly retrievably disposed in the pump housing interior. The jet pump assembly includes a carrier, a carrier nozzle in the carrier and at least one carrier opening in the carrier and establishing communication between the carrier nozzle and the pump housing interior. The jet pump assembly is adapted to be selectively removed from the pump housing interior through the tubing string as the pump housing remains attached to the tubing string. The carrier or the jet pump assembly is selectively positional in a first orientation in the pump housing interior to facilitate operation of the jet pump in a first fluid flow direction operational mode. The carrier of the jet pump assembly is selectively positional in a second orientation in the pump housing interior to facilitate operation of the jet pump in a second fluid flow direction operational mode opposite the first fluid flow direction operational mode.

16 Claims, 10 Drawing Sheets

(56) References Cited

U.S. PATENT DOCUMENTS

| | | | | | |
|---|---|---|---|---|---|
| 4,664,603 | A * | 5/1987 | Priestly | F04F 5/464 | 417/172 |
| 4,753,577 | A * | 6/1988 | Black | F04F 5/464 | 417/172 |
| 4,790,376 | A | 12/1988 | Weeks | | |
| 5,083,609 | A * | 1/1992 | Coleman | E21B 43/124 | 166/105 |
| 5,372,190 | A | 12/1994 | Coleman | | |
| 7,909,089 | B2 | 3/2011 | Jackson | | |
| 2005/0121191 | A1 | 6/2005 | Lambert et al. | | |
| 2007/0187111 | A1 | 8/2007 | Misselbrook et al. | | |
| 2008/0314578 | A1 * | 12/2008 | Jackson | E21B 43/124 | 166/68 |
| 2014/0003965 | A1 * | 1/2014 | James | F04F 5/00 | 417/53 |

* cited by examiner

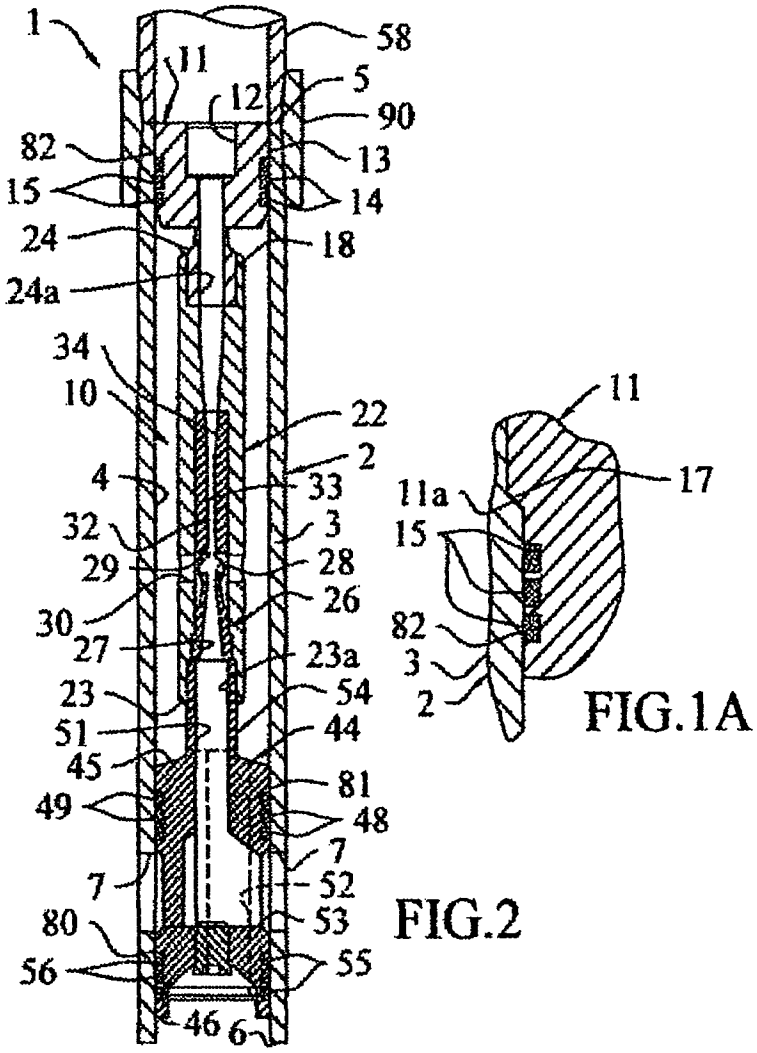
FIG.2
FIG.1A
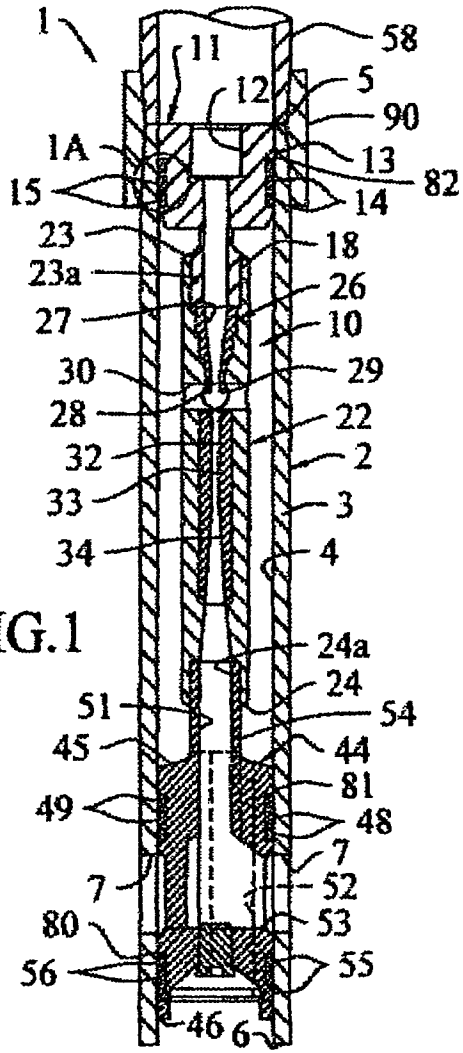
FIG.1

WELL FLUID EXTRACTION JET PUMP PROVIDING ACCESS THROUGH AND BELOW PACKER

CROSS-REFERENCE TO RELATED APPLICATIONS

This application claims the benefit of U.S. provisional application No. 61/604,564, filed Feb. 29, 2012 and entitled REVERSIBLE OPERATION JET PUMP, which provisional application is incorporated by reference herein in its entirety.

FIELD

Illustrative embodiments of the disclosure generally relate to jet pumps. More particularly, illustrative embodiments of the disclosure relate to a reversible operation jet pump which is suitable for hydrocarbon production applications and allows maintenance access through the pump to well depths below the pump. Illustrative embodiments of the disclosure further relate to methods of extracting well fluids from a subterranean well by operation of a reversible operation jet pump which allows maintenance access through the pump to well depths below the pump.

BACKGROUND

A conventional jet pump generally includes a jet pump housing, a nozzle having a converging nozzle bore in the jet pump housing, a nozzle tip which communicates with the nozzle bore and terminates in a nozzle chamber, a mixing chamber which communicates with the nozzle chamber and a diverging passage which communicates with the mixing chamber. As it flows through the nozzle, a pressurized power fluid creates a smaller, higher velocity stream which draws a suction fluid into the nozzle chamber and further into the mixing chamber. The mixed fluid expands in the diverging passage, reducing the velocity and increasing the pressure of the fluid. Jet pumps are suitable for a variety of applications including downhole applications, in which the pumps may be used to retrieve well fluid mixed with hydrocarbons to the well surface.

In hydrocarbon production applications, the jet pump housing of a jet pump is attached to a tubing string which is inserted in a well bore. Power fluid is pumped through the tubing string into the jet pump. As the power fluid flows through the nozzle in the jet pump housing, reservoir fluid from the well bore is drawn into the jet pump via a pressure drop generated by the power fluid and mixes with the power fluid. The fluid mixture, which includes power fluid and reservoir fluid, flows through the well annulus to the well surface or up the tubing in case of reverse flow.

One of the limitations or conventional jet pumps which are used in hydrocarbon production applications is that the diffuser and/or other components of the jet pump may be immovably attached to the jet pump housing. Consequently, these components hinder downhole cleaning and/or maintenance operations in the well bore and thus, the tubing string must be removed from the well bore in order to perform these operations. Thus, a reversible operation jet pump which includes a housing that is attached to a tubing string and from which a jet pump assembly including the functional components of the jet pump can be selectively removed from the housing while the housing remains in place in the tubing string, allowing for unobstructed cleaning and/or maintenance of the well bore is desirable. A reversible operation jet pump which includes a jet pump assembly that can be selectively re-oriented in the jet pump housing to facilitate reversible operation, in combination with the fore-stated through accessibility, of the jet pump is also desirable.

SUMMARY

An illustrative embodiment of a through-accessible and reversible operation jet pump for attachment to a tubing string includes a pump housing having a pump housing interior and a jet pump assembly retrievably disposed in the pump housing interior. The jet pump assembly includes a carrier, a carrier nozzle in the carrier and at least one carrier opening in the carrier and establishing communication between the carrier nozzle and the pump housing interior. The jet pump assembly is adapted to be selectively removed from the pump housing interior through the tubing string as the pump housing remains attached to the tubing string. The carrier of the jet pump assembly is selectively positional in a first orientation in the pump housing interior to facilitate operation of the jet pump in a first fluid flow direction operational mode. The carrier of the jet pump assembly is selectively positional in a second orientation in the pump housing interior to facilitate operation of the jet pump in a second fluid flow direction operational mode opposite the first fluid flow direction operational mode.

An illustrative embodiment of a method of extracting a well fluid from a subterranean well includes providing a jet pump including a pump housing having a pump housing interior and a jet pump assembly retrievably disposed in the pump housing interior and having a carrier, a carrier nozzle in the carrier and at least one carrier opening in the carrier and establishing communication between the carrier nozzle and the pump housing interior; selectively positioning the carrier of the jet pump in a selected one of a first orientation and a second orientation in the pump housing interior; attaching the pump housing to a tubing string; inserting the jet pump in a well casing in the subterranean well with a well annulus between the tubing string and the well casing; and operating the jet pump in a selected one of a first fluid flow direction operational mode to extract fluid from the well through the well annulus and a second fluid flow direction operational mode to extract fluid from the well through the jet pump.

An illustrative embodiment of a method of accessing a subterranean well includes providing a through-accessible reversible operation jet pump including a pump housing having a pump housing interior and a jet pump assembly retrievably disposed in the pump housing interior; attaching the pump housing to a tubing string; inserting the jet pump in a well casing; operating the jet pump to extract fluid from the well through the tubing string; retrieving the jet pump assembly from the pump housing interior of the pump housing through the tubing string as the pump housing remains on the tubing string in the well casing; and accessing the well below the pump housing through the tubing string and the pump housing interior of the pump housing.

BRIEF DESCRIPTION OF THE DRAWINGS

Illustrative embodiments of the disclosure will now be made, by way of example, with reference to the accompanying drawings, in which:

FIG. 1 is a longitudinal sectional view of an illustrative embodiment of the through-accessible reversible operation jet pump, coupled to a tubing string (partially in section) and more particularly illustrating a first configuration of the pump in which power fluid (not illustrated) flows in a first direction through the pump;

FIG. 1A is an enlarged sectional view, taken along section line 1A in FIG. 1, more particularly illustrating an exemplary proximal seal lip with a carriage head support surface for supporting a proximal carriage head of a jet pump assembly in a pump housing interior or a pump housing;

FIG. 2 is a longitudinal sectional view of an illustrative embodiment of the through-accessible reversible operation jet pump, more particularly illustrating a second configuration or the pump in which power fluid (not illustrated) flows in a second direction opposite the first direction through the pump;

DETAILED DESCRIPTION

Figure 4:
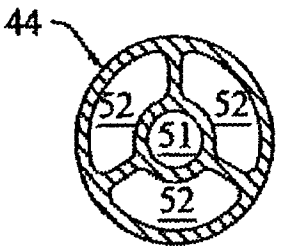
FIG. 4 is a cross-sectional view, taken along section lines 4-4 in FIG. 3, of the distal carriage head.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is non-limiting and is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be hound by any expressed or implied theory presented in the preceding technical field, background, brief summary or the following detailed description. Relative terms such as "upper", "lower", "above", "below", "top", "horizontal" and "vertical" as used herein are intended for descriptive purposes only and are not necessarily intended to be construed in a limiting sense. As used herein, the term "proximal" means "closer to the well surface" whereas the term "distal" as used herein means "further from the well surface".

Referring initially to FIGS. 1-6 of the drawings, an illustrative embodiment of the well fluid extraction reversible operation jet pump providing access through and below packer, hereinafter jet pump, is generally indicated by reference numeral 1 in FIGS. 1 and 2. The jet pump 1 includes a pump housing 2. The pump housing 2 includes a pump housing wall 3 which may be generally elongated and cylindrical. The pump housing wall 3 of the pump housing 2 has a pump housing interior 4. The pump housing 2 may have a proximal housing end 5 and a distal housing end 6. At least one pump housing opening 7 may extend through the pump housing wall 3 of the pump housing 2 for purposes which will be hereinafter described. As illustrated in FIG. 1A, in some embodiments, an annular proximal seal lip 82 may protrude from the inner surface of the pump housing wall 3 into the pump housing interior 4. The proximal seal lip 82 may have a beveled carriage head support surface 17, the purpose of which will be hereinafter described.

A jet pump assembly 10 is disposed in the pump housing interior 4 of the pump housing 2. The jet pump assembly 10 is selectively removable from the pump housing interior 4 for purposes which will be hereinafter described. The jet pump assembly 10 may include a proximal carriage head 11 which is normally generally proximate the proximal housing end 5 of the pump housing 2. The proximal carriage head 11 has a proximal carriage head bore 12. At least one proximal seal groove 14 may be provided in an outer surface 13 of the proximal carriage head 11. A proximal seal 15 is seated in each proximal seal groove 14 to impart a fluid-tight seal between the outer surface 13 of the proximal carriage head 11 and the interior surface of the pump housing wall 3. A proximal carriage head neck 18 may extend from the proximal carriage head 11 for attachment purposes as will be hereinafter described. As illustrated in FIG. 1A, in some embodiments, the proximal carriage head 11 may have an annular carriage head bevel 11*a* which engages the complementary-shaped carriage head support surface 17 on the proximal seal lip 82 such that the carriage head support surface 17 supports the jet pump assembly 10 in the pump housing interior 4.

The jet pump assembly 10 may further include a distal carriage head 44. The distal carriage head 44 may have a proximal head end 45 and a distal head end 46. A proximal carriage head neck 54 may extend from the proximal head end 45 for attachment purposes as will be hereinafter described. At least one middle seal groove 48 may be provided in an exterior surface of the distal carriage head 44 generally proximate the proximal head end 45. A middle seal 49 is seated in each middle seal groove 48 to impart a fluid-tight seal between the distal carriage head 44 and the interior surface of the pump housing wall 3. At least one distal seal groove 55 may be provided in the exterior surface of the distal carriage head 44 generally proximate the distal head end 46. A distal seal 56 is seated in each distal seal groove 55 to impart a fluid-tight seal between the distal carriage head 44 and the interior surface of the pump housing wall 3.

Figure 5:
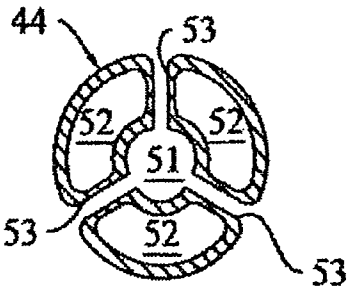
FIG. 5 is a cross-sectional view, taken along section lines 5-5 in FIG. 3, of the distal carriage head.
Figure 6:
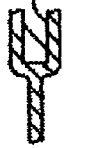
FIG. 6 is a sectional view taken along section lines 6-6 in FIG. 3.
Figure 3:
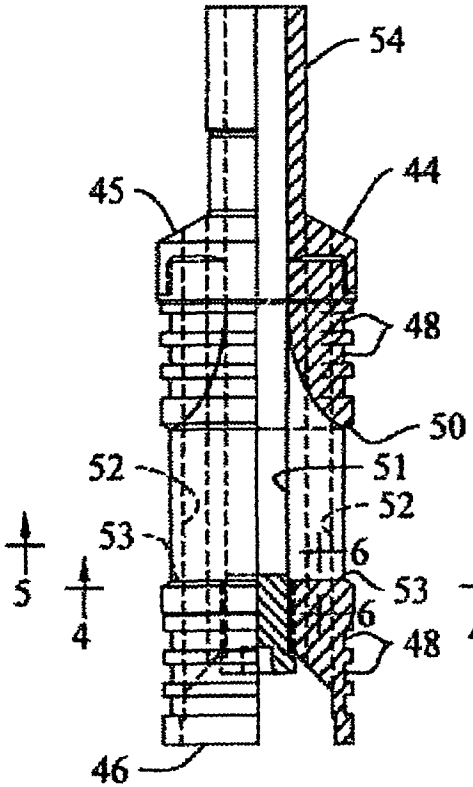
FIG. 3 is a side view, partially in section, of a distal carriage head element of an illustrative embodiment of the through-accessible reversible operation jet pump.

As illustrated in FIGS. 3-5, a distal carriage head bore 51 extends through the distal carriage head neck 54 and a portion of the distal carriage head 44. At least one reservoir fluid passage 52 extends through the distal carriage head 44 from the proximal head end 45 to the distal head end 46, and opens to the proximal head end 45 and the distal head end 46. As further illustrated in FIGS. 4 and 5, the distal carriage head bore 51 may extend through a central portion of the distal carriage head 44. Multiple reservoir fluid passages 52 may extend through outer portions of the distal carriage head 44 in surrounding relationship to the distal carriage head bore 51. As illustrated in FIGS. 3 and 5, between the proximal head end 45 and the distal head end 46 of the distal carriage head 44, at least one fluid outlet opening 53 establishes fluid communication between the distal carriage head bore 51 and the exterior of the distal carriage head 44.

As further illustrated in FIGS. 1 and 2, a carrier 22 is detachably coupled to and extends between the proximal carriage head 11 and the distill carriage head 44. The carrier 22 can be selectively attached to the proximal carriage head 11 and the distal carriage head 44 in a first orientation (FIG. 1) to facilitate flow of fluid through the jet pump assembly 10 in a downward direction. The carrier 22 can be selectively detached from and then re-attached to the proximal carriage head 11 and the distal carriage head 44 in the opposite orientation (FIG. 2) to facilitate flow of fluid through the jet pump assembly 10 in an upward direction for purposes which will be hereinafter described. The carrier 22 may have a carrier inlet end 23 and a carrier outlet end 24. The carrier inlet end 23 may have inlet threads 23*a* and the carrier outlet end 24 may have outlet threads 24*a* for attachment purposes as will be hereinafter described. A carrier nozzle 26 is disposed inside the carrier 22 and includes a nozzle bore 27 which converges towards the carrier outlet end 24. A nozzle tip 28 terminates the nozzle bore 27. A nozzle chamber 29 communicates with the nozzle tip 28. At least one carrier opening 30 in the carrier 22 establishes communication between the nozzle chamber 29 and the pump housing interior 4 of the pump housing 2.

A mixing chamber 32 communicates with the nozzle chamber 29. The mixing chamber 32 may include a straight chamber segment 33 which extends from the nozzle chamber 29 and a diverging chamber segment 34 which extends from the straight chamber segment 33. The diverging chamber segment 34 may terminate generally at or adjacent to the outlet threads 24*a* or the carrier 22.

Figure 8:
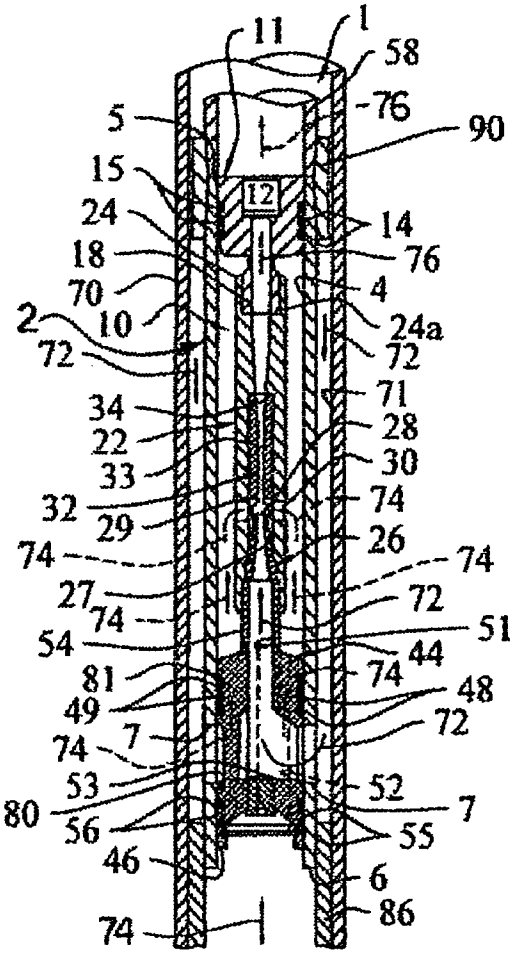
FIG. 8 is a longitudinal sectional view of the through-accessible reversible operation jet pump, deployed in a well casing in a subterranean well and more particularly illustrating flow of power fluid downwardly through the annulus between the pump housing and the well casing and then into and upwardly through the jet pump to the well surface, respectively, to draw reservoir fluid from the well to the well surface with the power fluid.
Figure 7:
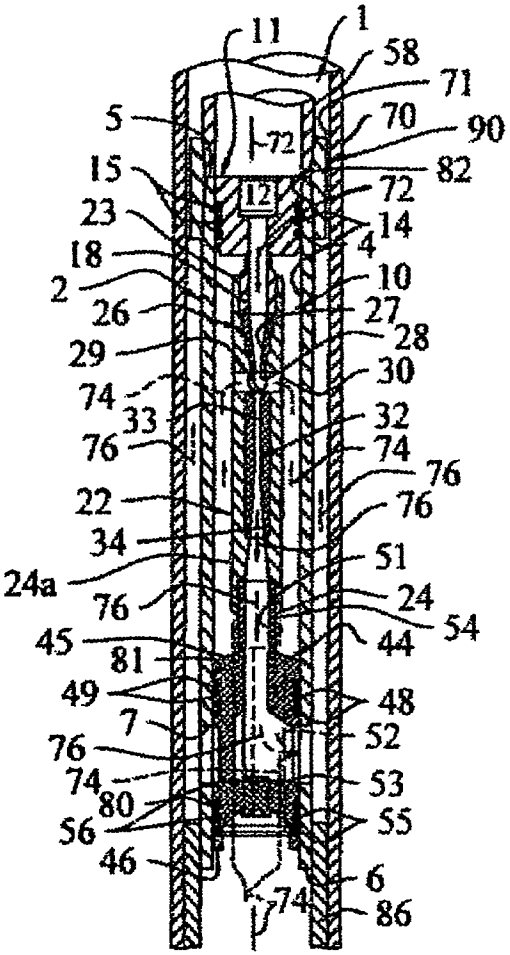
FIG. 7 is a longitudinal sectional view of the through-accessible reversible operation jet pump, deployed in a well casing in a subterranean well and more particularly illustrating flow of power fluid downwardly through the jet pump and then into and upwardly through the annulus between the well casing and the jet pump housing to the well surface, respectively, to draw reservoir fluid from the well to the well surface with the power fluid.
Figure 9:
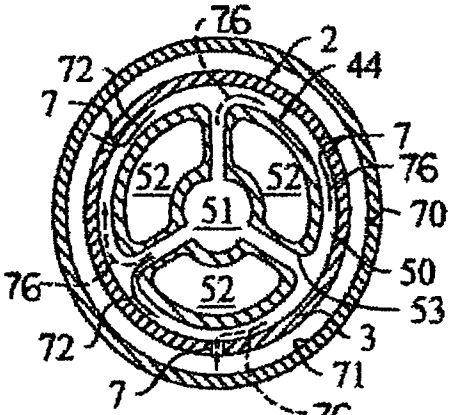
FIG. 9 is a cress-sectional view of the distal carriage head element of the jet pump taken along section lines 5-5 in FIG. 3, with the jet pump disposed in the well casing and more particularly illustrating flow of power fluid and reservoir fluid from the distal carriage head bore of the distal carriage head and through pump housing openings in the pump housing into the annulus between the pump housing and the well casing.

Referring next to FIGS. 7-9 of the drawings, in exemplary application, the jet pump 1 is attached to a tubing string 58 and inserted in a well casing 70 deployed in a subterranean hydrocarbon well to extract reservoir fluid 74 from the well. The reservoir fluid 74 which is extracted from the well may include water as well as hydrocarbons. At the well surface, the hydrocarbons may be separated from the extracted reservoir fluid 74 using techniques which are known by those skilled in the art. In some applications, the well casing 70 may be disposed in a vertical orientation, as illustrated in FIGS. 7 and 8. Thus, the following description is based on a vertical orientation of the well casing 70 in the subterranean hydrocarbon well. It is to be understood, however, that in other applications, the well casing 70 may be disposed in a horizontal orientation or in any orientation between a vertical orientation and a horizontal orientation.

At the well surface, the pump housing 2 of the reversible operation jet pump 1 may be attached to the tubing string 58 at a threaded coupling 90. A packer 86 may be attached to the pump housing 2 typically at a threaded attachment (not illustrated). The pump housing 2, with the packer 86 attached thereto, are lowered into the well casing 70 on the tubing string 58. At the desired depth, the packer 86 may be deployed in the well casing 70 by extending gripping elements (not illustrated) from the packer 86 which engage the well casing 70 typically via rotation of the tubing string 58 in the conventional manner.

As illustrated in FIG. 7, in a first fluid flow direction operational mode of the reversible operation jet pump 1, the jet pump assembly 10 may be configured in a first orientation in the pump housing interior 4 to facilitate downward flow of power fluid 72 (which may include water and/or oil, for example and without limitation) from the well surface through the tubing string 58 and the jet pump assembly 10, respectively, and upward flow of a fluid mixture 76 or power fluid 72 and reservoir fluid 74 to the well surface through the well annulus 71 between the pump housing 2 and the well casing 70. As illustrated in FIG. 8, in a second fluid flow direction operational mode of the reversible operation jet pump 1, the jet pump assembly 10 may be configured in a second orientation in the pump housing interior 4 to facilitate downward flow of power fluid 72 from the well surface through the well annulus 71 and upward flow of a fluid mixture 76 of power fluid 72 and reservoir fluid 74 to the well surface through the jet pump assembly 10 and the tubing string 58, respectively. The jet pump assembly 10 is selectively configured in the first orientation (FIG. 7) by orienting the carrier 22 such that the carrier nozzle 26 accommodates downward flow of power fluid 72 through the jet pump assembly 10. This is accomplished by coupling the carrier inlet end 23 of the carrier 22 to the proximal carriage head neck 18 of the proximal carriage head 11 and coupling the carrier outlet end 24 of the carrier 22 to the distal carriage head neck 54 of the distal carriage head 44. The jet pump assembly 10 is selectively configured in the second orientation (FIG. 8) by orienting the carrier 22 such that the carrier nozzle 26 accommodates upward flow of power fluid 72 and reservoir fluid 74 through the jet pump assembly 10. This is accomplished by coupling the carrier inlet end 23 of the carrier 22 to the distal carriage head neck 54 of the distal carriage head 44 and coupling the carrier outlet end 24 of the carrier 22 to the proximal carriage head neck 18 of the proximal carriage head 11.

In either fluid flow direction operational mode of operation, as the reversible operation jet pump 1 is inserted in place in the well casing 70 on the tubing string 58, the reservoir fluid 74 in the well flows upwardly through the reservoir fluid passages 52 in the distal carriage head 44 into the pump housing interior 4 of the pump housing 2. The reservoir fluid 74 generally surrounds the carrier 22, including the carrier openings 30 which establish fluid communication between the pump housing interior 4 and the nozzle chamber 29. In the first fluid flow direction operational mode of operation (FIG. 7) of the reversible jet pump 1, power fluid 72 is pumped downwardly through the tubing string 58 and the jet pump assembly 10, respectively. Accordingly, the power fluid 72 flows through the proximal carriage head bore 12 of the proximal carriage head 11 and the converging nozzle bore 27, the nozzle tip 28 and the nozzle chamber 29, respectively, of the carrier nozzle 26. In the mixing chamber 32, the power fluid 72 mixes with reservoir fluid 74 and the resulting fluid mixture 76 flows through the distal carriage head bore 51 of the distal carriage head 44. From the distal carriage head bore 51, the fluid mixture 76 flows through the fluid outlet openings 53 (FIG. 5) and the pump housing openings 7 in the pump housing wall 3, respectively, into the well annulus 71.

As the reversible operation jet pump 1 is installed in the well casing 70, the fluid outlet openings 53 in the distal carriage head 44 of the jet pump assembly 10 may be misaligned with the pump housing openings 7 in the pump housing 2, as illustrated in FIG. 9. However, an annular fluid flow space 50 is formed between the exterior surface of the distal carriage head 44 and the interior surface of the pump housing wall 3. Therefore, the fluid mixture 76 flows freely from the distal carriage head bore 51 through the fluid outlet openings 53, the fluid flow space 50 and the pump housing openings 7, respectively, into the well annulus 71.

As the power fluid 72 flows through the converging nozzle bore 27 of the carrier nozzle 26, the pressure of the power fluid 72 drops substantially as it is discharged from the nozzle tip 28 into the nozzle chamber 29. A vacuum generated in the mixing chamber 32 by flowing power fluid 72 is less than the pressure of the reservoir fluid 74 in the pump housing interior 4. Consequently, the reservoir fluid 74 is drawn from the pump housing interior 4 into the nozzle chamber 29 through the carrier openings 30 via the power fluid-generated pressure drop in the mixing chamber 32 and mixes with the power fluid 72. As it flows through the mixing chamber 32, the pressure of the power fluid 72 and the reservoir fluid 74 remains low and then increases again as the fluids flow through the diverging chamber segment 34 of the mixing chamber 32 and the distal carriage head bore 51 of the distal carriage head 44. As further illustrated in FIG. 7, the reservoir fluid 74 flows with the power fluid 72 from the distal carriage head bore 51 through the fluid outlet openings 53 (FIG. 5), the pump housing openings 7 in the pump housing 2 and the well annulus 71, respectively, to the well surface. At the well surface, the hydrocarbons may be separated from the power fluid 72 and the reservoir fluid 74 using techniques which are known by those skilled in the art. Due to the drop in pressure of the reservoir fluid 74 in the pump housing interior 4, caused by flow of the reservoir fluid 74 from the pump housing interior 4 into the jet pump assembly 10 through the carrier openings 30, reservoir fluid 74 continues to flow from the well through the reservoir fluid passages 52 (FIGS. 4 and 5) into the pump housing interior 4. Throughout operation of the reversible operation jet pump 1 in the first fluid flow direction operational mode, the downward pressure of the power fluid 72 maintains the jet pump assembly 10 deployed in place in the pump housing 2.

In some applications, the reservoir fluid 74 may carry sand and/or other particulate matter which may have a tendency to abrade or corrode the well casing 70 as the reservoir fluid 74 is ejected from the pump housing openings 7 into the well annulus 71 and as it flows through the well annulus 71 to the well surface. In such applications, therefore, it may be desirable to operate the reversible operation jet pump 1 in the second fluid flow direction operational mode in which the reservoir fluid 74 is pumped to the well surface through the jet pump 1 instead of through the well annulus 71. Accordingly, as illustrated in FIG. 8, the carrier 22 is configured in the second orientation in the jet pump assembly 10 such that the carrier nozzle 26 accommodates upward flow of the fluid mixture 76 (which includes the power fluid 72 and the reservoir fluid 74) through the jet pump assembly 10.

Reservoir fluid 74 initially flows from the well through the reservoir fluid passages 52 (FIGS. 4 and 5) into the pump housing interior 4 and surrounds the carrier 22. Power fluid 72 is pumped downwardly through the well annulus 71. The power fluid 72 flows from the well annulus 71 through the pump housing openings 7 and the fluid outlet openings 53 (FIG. 5), respectively, into the distal carriage head bore 51 of the distal carriage head 44. From the distal carriage head bore 51, the power fluid 72 flows upwardly through the converging nozzle bore 27 and is discharged from the nozzle tip 28 into the nozzle chamber 29, respectively, of the carrier nozzle 26. Due to the resulting fluid pressure drop in the mixing chamber 32, and other jet flow phenomenon, reservoir fluid 74 is drawn from the pump housing interior 4 through the carrier openings 30 and into the nozzle chamber 29, respectively. The power fluid 72 and the reservoir fluid 74 mix to form the fluid mixture 76, which flows upwardly through the mixing chamber 32, the proximal carriage head bore 12 of the proximal carriage head 11 and the tubing string 58, respectively, to the well surface. As the reservoir fluid 74 is drawn via the power fluid-generated pressure drop from the pump housing interior 4 through the carrier openings 30 into the nozzle chamber 29, additional reservoir fluid 74 continues to flow upwardly through the reservoir fluid passages 52 (FIGS. 4 and 5) into the pump housing interior 4. Throughout flow of the fluid mixture 76 upwardly through the jet pump assembly 10 and the tubing string 58, respectively, to the well surface, a column of reservoir fluid (not illustrated) typically remains in the tubing string 58 above the proximal carriage head 11 and maintains sufficient downward force against the proximal carriage head 11 to maintain the jet pump assembly 10 in place in the pump housing 2.

Figure 10:
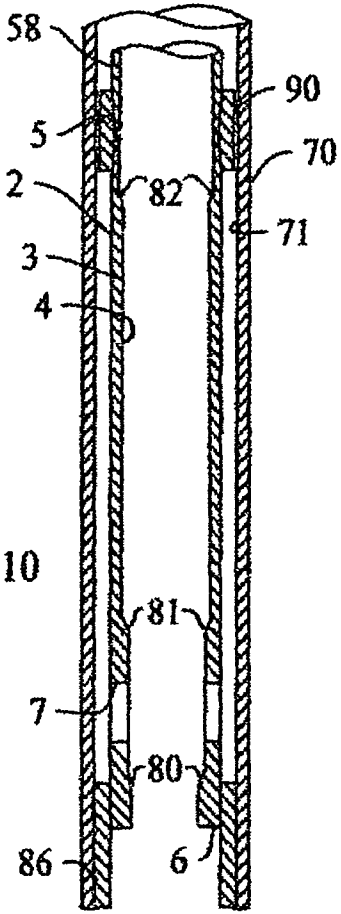
FIG. 10 is a longitudinal sectional view of the pump housing, with the jet pump assembly of the jet pump removed from the pump housing for cleaning or maintenance of depths within the well bore below the pump housing.

Referring next to FIG. 10 of the drawings, it will be appreciated by those skilled in the art that when it is deployed in either the first fluid flow direction operational mode (FIG. 7) or the second fluid flow direction operational mode (FIG. 8), the jet pomp assembly 10 can be selectively removed from the pump housing interior 4 of the pump housing 2 while the pump housing 2 remains deployed on the tubing string 58 in the well casing 70. This expedient facilitates cleaning, maintenance and/or replacement of the jet pump assembly 10, re-orientation of the carrier 22 to facilitate reverse flow through the jet pump assembly 10, and/or clear access to the pump housing interior 4 and downhole elements of the well through the pump housing interior 4 for cleaning, maintenance, etc. of the downhole elements of the well below the level of the pump housing 2. Accordingly, in the first fluid flow direction operational mode (FIG. 7), power fluid 72 is initially pumped downwardly through the well annulus 71 and flows through the pump housing openings 7 in the pump housing 2 and the fluid outlet openings 53 in the distal carriage head 44, respectively. A first portion of the power fluid 72 flows upwardly through the distal carriage head bore 51 in the distal carriage head 44, the mixing chamber 32 and the carrier openings 30, respectively, and is discharged into the pump housing interior 4. In the pump housing interior 4, the first portion of the power fluid 72 exerts upward pressure against the proximal carriage head 11. A second portion of the power fluid 72 flows downwardly through the reservoir fluid passages 52 in the distal carriage head 44 and is discharged into the downhole portion of the well at the distal head end 46, creating a jet propulsion effect. Pressure builds up against a one-way check valve (standing valve) mounted below the jet pump assembly 10 to prevent flow of the fluid deeper into the well beyond the check valve. This fluid pressure pushes the jet pump assembly 10 upwardly in the pump housing 2 and through the tubing string 58 to the well surface.

It will be appreciated by those skilled in the art that under circumstances in which the jet pump assembly 10 cannot be retrieved by circulation of the power fluid 72 as in the second fluid flow direction operational mode, as described herein above, a conventional wireline (not illustrated) can be attached to the proximal carriage head 11 and used to retrieve the jet pump assembly 10 through the tubing string 58. Additionally, the orientation of the carrier 22 in the jet pump assembly 10 can be changed to facilitate flow of the fluid mixture 76 which includes the reservoir fluid 74 to the well surface through the well annulus 71, as was heretofore described with respect to FIG. 7, or through the jet pump assembly 10, as was heretofore described with respect to FIG. 8. The same components of the jet pump assembly 10 can be used for flow of the reservoir fluid 74 in either fluid flow direction operational mode. The reversible operation jet pump 1 is amenable to use of top and/or bottom standing valves.

Referring again to FIG. 10 of the drawings, in some embodiments of the reversible operation jet pump 1, a distal seal lip 80, a middle seal lip 81 and a proximal Seal lip 82 may protrude from the pump housing wall 3 into the pump housing interior 4. The diameter of the pump housing interior 4 corresponds to and progressively decreases below the proximal seal lip 82, the middle seal lip 81 and the distal seal lip 80, respectively. As illustrated in FIGS. 1 and 2, when the jet pump assembly 10 is deployed in the operational position in the pump housing 2, the proximal seals 15 are disposed just below the proximal seal lip 82; the middle seals 49 are disposed just below the middle seal lip 81; and the distal seals 56 are disposed just below the distal seal lip 80. Therefore, as the jet pump assembly 10 is lowered into the pump housing interior 4 typically from the well surface, the distal seals 56 engage the interior surface of the pump housing wall 3 only as they travel below the distal seal lip 80. Similarly, the middle seals 49 engage the interior surface of the pump housing wall 3 only as they travel below the middle seal lip 81 and the proximal seals 15 engage the interior surface of the pump housing wall 3 only as they travel below the proximal seal lip 82. This expedient prevents premature wear of the proximal seals 15, the middle seals 49 and the distal seals 56 during insertion and retrieval of the jet pump assembly 10 with respect to the pump housing and facilitates ease of seating of the jet pump assembly 10 as disposed in the jet pump housing 2.

Figure 11:
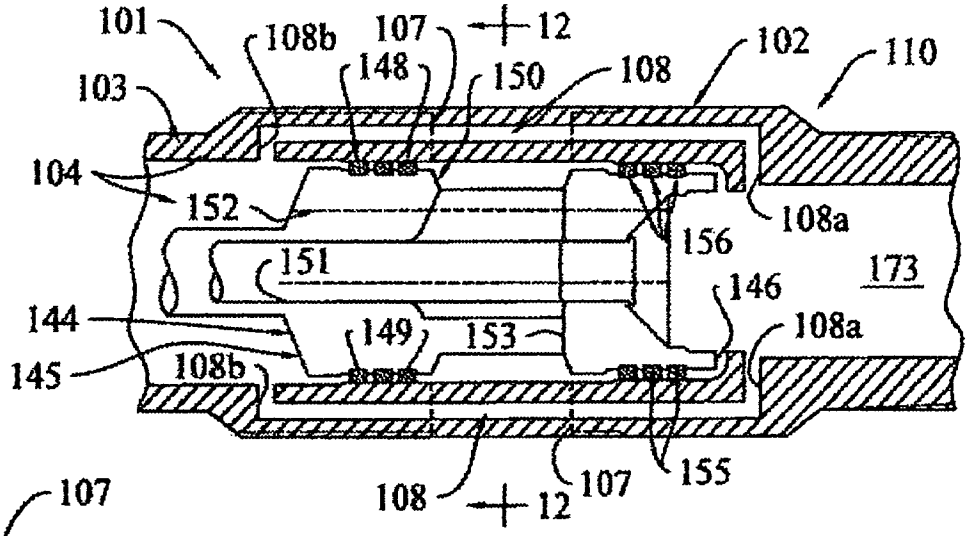
FIG. 11 is a longitudinal sectional view of a portion of an alternative illustrative embodiment of the through-accessible reversible operation jet pump, more particularly illustrating suction ports in the pump housing.
Figure 12:
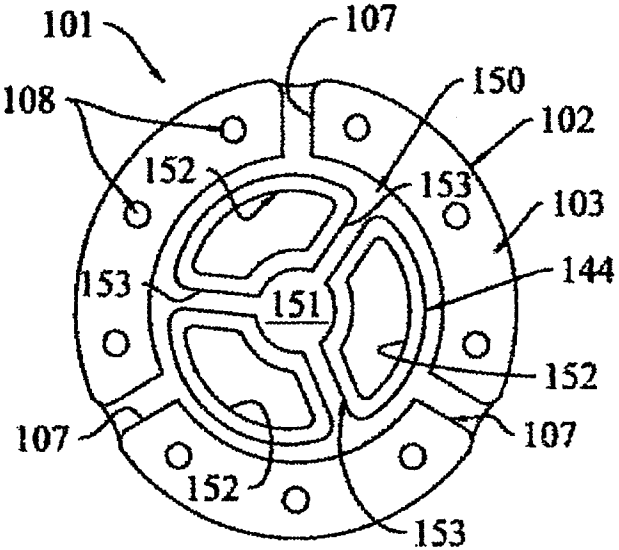
FIG. 12 is a cross-sectional view, taken along section lines 12-12 in FIG. 11.

Referring next to FIGS. 11, 12, 15 and 16 of the drawings, an alternative illustrative embodiment of the reversible operation jet pump, partially in section, is generally indicated by reference numeral 101. In the reversible operation jet pump 101. elements which are analogous to the respective elements of the reversible operation jet pump 1 that was heretofore described with respect to FIGS. 1-10 are designated by the same numeral in the 101-199 series. Multiple suction ports 108 extend through and along the pump housing wall 103 of the pump housing 102. As illustrated in FIG. 11, the suction ports 108 may be oriented in generally parallel relationship to the longitudinal axis of the pump housing 102. As illustrated in FIG. 12, in cross-sectional view, the suction ports 108 may be arranged in spaced apart relationship to each other around the circumference of the pump housing 102. As illustrated in FIG. 11, each suction port 108 may have a suction port inlet 108*a* and a suction port outlet 108*b*. The suction port inlet 108*a* may be disposed in fluid communication with the well bore 173 which is beneath the distal carriage head 144. The suction port outlet 108*b* may be disposed in fluid communication with the pump housing interior 104 above the distal carriage head 144.

Figure 13:
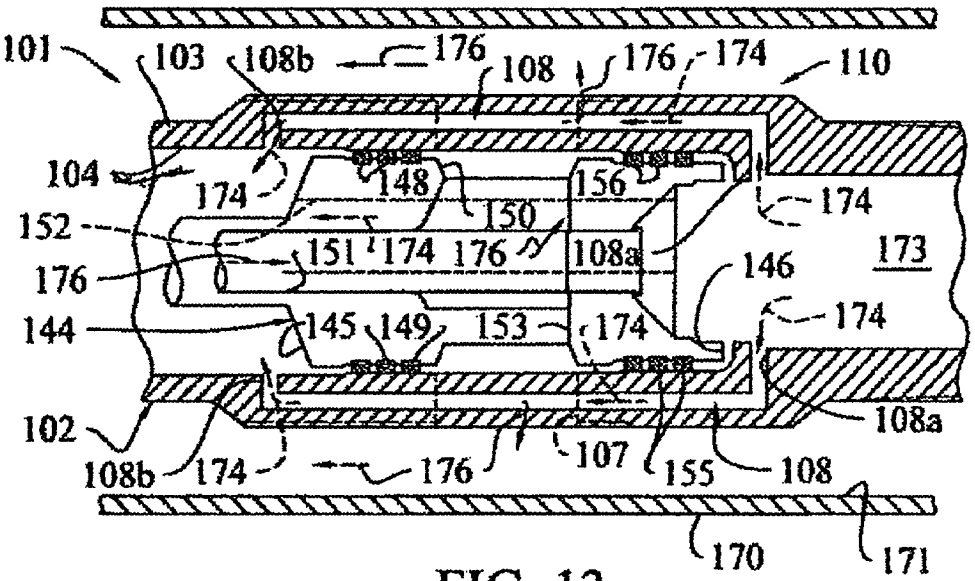
FIG. 13 is a longitudinal sectional view of the portion of the through-accessible reversible operation jet pump illustrated in FIG. 11, more particularly illustrating flow of power fluid through the jet pump according to a first fluid flow direction operational mode to draw reservoir fluid from the well to the well surface with the power fluid.

Referring next to FIG. 13 of the drawings, operation of the reversible operation jet pump 101 in the first fluid flow direction operational mode may be as was heretofore described with respect to operation of the reversible operation jet pump 1 in the first fluid flow direction operational mode in FIG. 7. Therefore, some of the details of the fluid flow process are omitted here for brevity. Power fluid (not illustrated) is pumped downwardly from the well surface through the tubing string (not illustrated) into the jet pump assembly 110. A first portion of the reservoir fluid 174 flows from the well bore 173 into and through the suction ports 108 in the pump housing wall 103 through the respective suction port inlets 108*a*. The reservoir fluid 174 is discharged from the suction ports 108 into the pump housing interior 104 through the respective suction port outlets 108*b*. A second portion of the reservoir fluid 174 flows from the well bore 173 through the reservoir fluid passages 152 in the distal carriage head 144 into the pump housing interior 104. In the jet pump assembly 110, the power fluid mixes with reservoir fluid 174 to form a fluid mixture 176. The fluid mixture 176 flows downwardly through the distal carriage head bore 151 of the distal carriage head 144 into the well annulus 171 through the fluid flow spaces 150 in the distal carriage head 144 and the pump housing openings 107 in the pump housing wall 103 of the pump housing 102, respectively. The fluid mixture 176 then flows upwardly through the well annulus 171 to the well surface.

Figure 14:
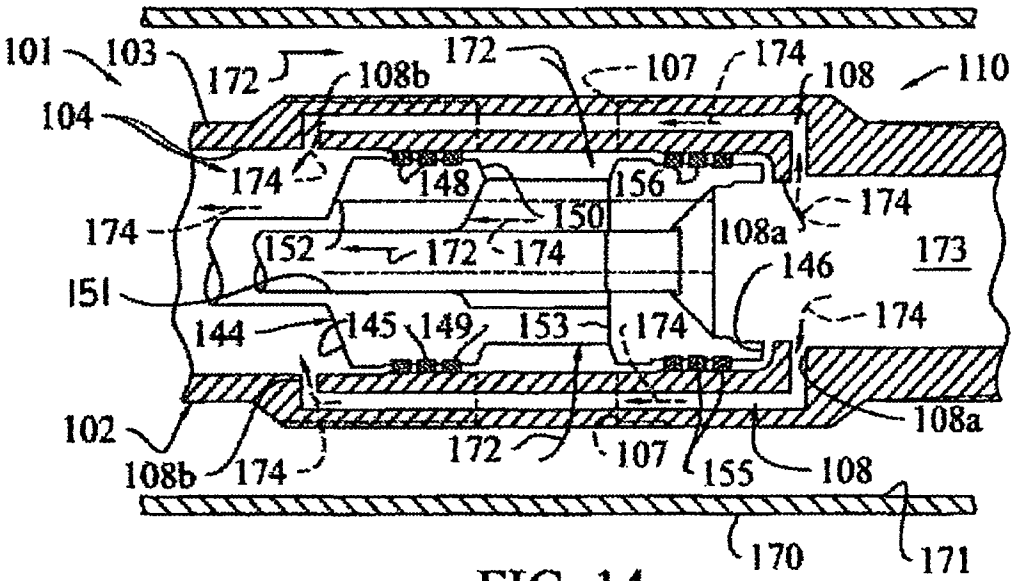
FIG. 14 is a longitudinal sectional view of the portion of the through-accessible reversible operation jet pump illustrated in FIG. 11, more particularly illustrating downward flow of power fluid through the annulus between the pump housing and the well casing and then into and upwardly through the jet pump to the well surface, respectively, according to a second fluid flow direction operational mode to draw reservoir fluid from the well to the well surface with the power fluid.
Figure 16:
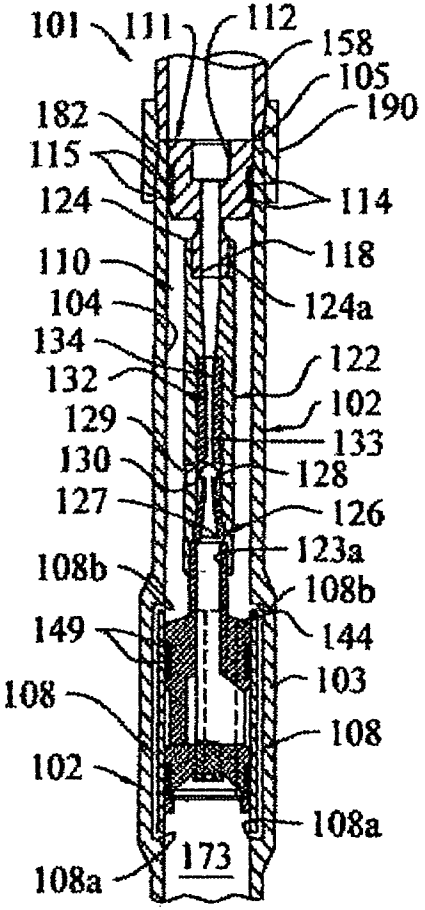
FIG. 16 is a longitudinal sectional view of the illustrative embodiment of the through-accessible reversible operation jet pump illustrated in FIG. 11 and more particularly illustrating a second configuration of the pump in which power fluid (not illustrated) flows in a second direction through the pump.
Figure 15:
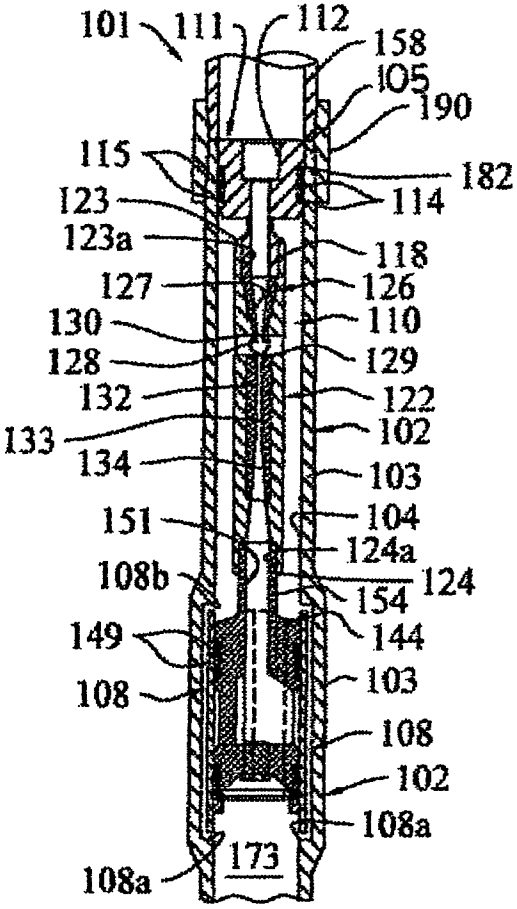
FIG. 15 is a longitudinal sectional view of the illustrative embodiment of the through-accessible reversible operation jet pump illustrated in FIG. 11 and more particularly illustrating a first configuration of the pump in which power fluid (not illustrated) flows in a first direction through the pump.

Referring next to FIG. 14 of the drawings, operation of the reversible operation jet pump 101 in the second fluid flow direction operational mode may be as was heretofore described with respect to operation of the reversible operation jet pump 1 in the second fluid flow direction operational mode in FIG. 8. Therefore, some of the details of the fluid flow process are omitted here for brevity. Power fluid 172 is pumped downwardly from the well surface through the well annulus 171. The power fluid 172 flows from the well annulus 171 through the pump housing openings 107 in the pump housing wall 103 of the pump housing 102 and the fluid flow spaces 150 in the distal carriage head 144, respectively, into and through the distal carriage head bore 151 of the distal carriage head 144. A first portion of the reservoir fluid 174 flows from the well bore 173 into the suction ports 108 through the respective suction port inlets 108*a*. The reservoir fluid 174 is discharged from the suction ports 108 into the pump housing interior 104 through the respective suction port outlets 108*b*. A second portion of the reservoir fluid 174 flows from the well bore 173 through the reservoir fluid passages 152 in the distal carriage head 144 into the pump housing interior 104 of the pump housing 102. In the jet pump assembly 110, the power fluid 172 mixes with reservoir fluid 174 to form a fluid mixture (not illustrated). The fluid mixture flows to the well surface through the tubing string.

Figure 17:
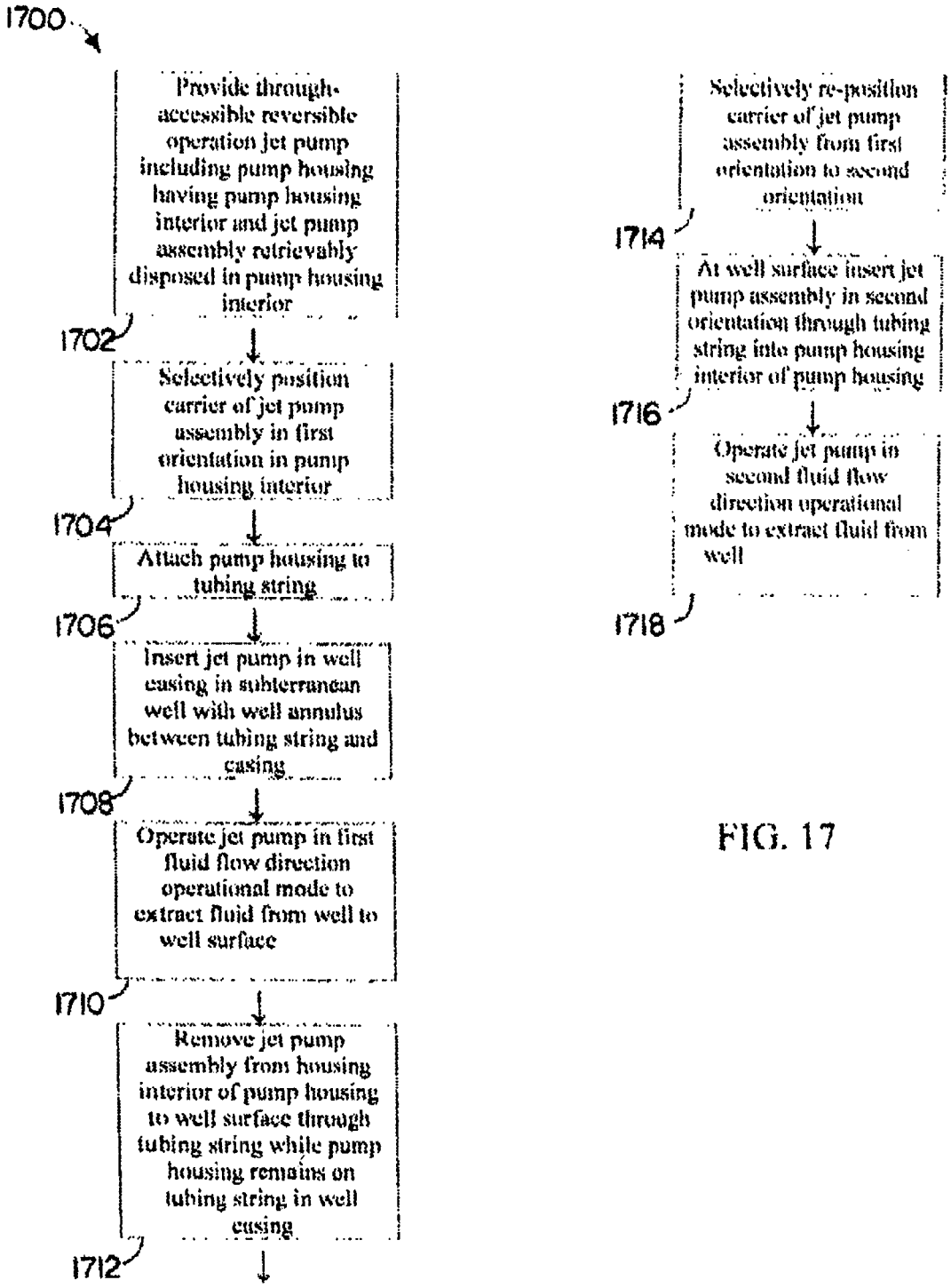
FIG. 17 is a flow diagram of an illustrative embodiment of a well fluid extraction method.

Referring next to FIG. 17 of the drawings, a flow diagram 1700 of an illustrative well fluid extraction method is illustrated. In block 1702, a through-accessible reversible operation jet pump is provided. The reversible operation jet pump may have a design which is the same as or similar to that of the reversible operation jet pumps which were heretofore described with respect to FIGS. 1-16. Accordingly, the reversible operation jet pump may include a pump housing having a pump housing interior and a jet pump assembly retrievably disposed in the pump housing interior. The jet pump assembly may include a carrier, a carrier nozzle in the carrier and at least one carrier opening in the carrier and establishing communication between the carrier nozzle and the pump housing interior.

In block 1704, the carrier of the jet pump assembly may be selectively positioned in a first orientation in the pump housing interior of the pump housing. In block 1706, the pump housing may be attached to a tubing string. In block 1708, the jet pump may be inserted in a well casing in a subterranean well with a well annulus between the tubing string and the casing.

In block 1710, the jet pump may be operated in a first fluid flow direction operational mode to extract a well fluid from the well to the well surface. In some embodiments, the well fluid may be extracted from the well through the well annulus such as in the manner which was heretofore described with respect to FIGS. 7 and 13. In other embodiments, the well fluid may be extracted from the well through the jet pump such as in the manner which was heretofore described with respect to FIGS. 8 and 14.

In block 1712, the jet pump assembly may be removed from the housing interior of the pump housing to the well surface through the tubing string while the pump housing remains on the tubing string in the well casing. In block 1714, the carrier of the jet pump assembly may be repositioned from the first orientation to a second orientation. In block 1716, at the well surface, the jet pump assembly, in the second orientation, may be inserted through the tubing string into the pump housing interior of the pump housing.

In block 1718, the jet pump may be operated in a second fluid flow direction operational mode to extract a fluid from the well. In some embodiments, the fluid may be extracted from the well through the jet pump such as in the manner which was heretofore described with respect to FIGS. 8 and 14. In other embodiments, the fluid may be extracted from the well through the well annulus such as in the manner which was heretofore described with respect to FIGS. 7 and 13.

Figure 18:
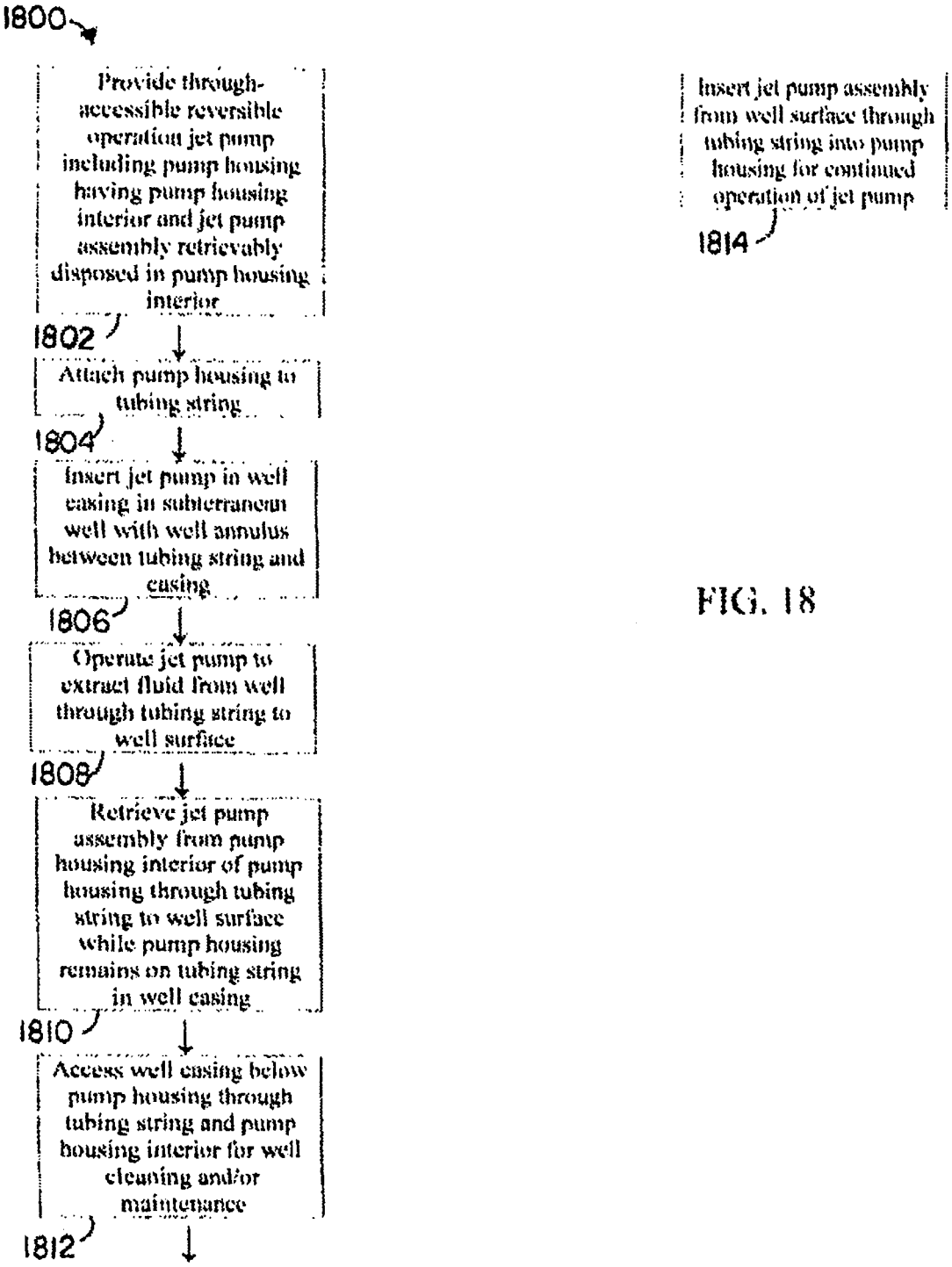
FIG. 18 is a flow diagram of an illustrative embodiment of a method of accessing a subterranean well.

Referring next to FIG. 18 of the drawings, a flow diagram 1800 of an illustrative embodiment of a well cleaning and/or maintenance method is illustrated. In block 1802, a through-accessible reversible operation jet pump is provided. The through-accessible reversible operation jet pump may have a design which is the same as or similar to that of the reversible operation jet pumps which were heretofore described with respect to FIGS. 1-16. Accordingly, the through-accessible reversible operation jet pump may include a pump housing having a pump housing interior and a jet pump assembly retrievably disposed in the pump housing interior. The jet pump assembly may include a carrier, a carrier nozzle in the carrier and at least one carrier opening in the carrier and establishing communication between the carrier nozzle and the pump housing interior.

In block 1804, a through-accessible reversible operation jet pump is operated to extract fluid from a subterranean well. The jet pump may be operated in a first fluid flow direction operational mode and/or a second fluid flow direction operational mode, as was heretofore described. In block 1806, a jet pump assembly may be retrieved from the pump housing interior of the pump housing through the tubing string to the well surface while the pump housing remains on the tubing string in the well casing. In block 1808, the well casing below the pump housing may be accessed through the pump housing interior of the jet pump for well cleaning and/or maintenance purposes. In block 1810, the jet pump assembly may be deployed in the jet pump housing for continued operation of the jet pump. This may be accomplished by inserting the jet pump assembly from the well surface through the tubing string into the pump housing interior of the pump housing.

While illustrative embodiments of the disclosure have been described above, it will be recognized and understood that various modifications can be made and the appended claims are intended to cover all such modifications which may fall within the spirit and scope of the disclosure.

What is claimed is:

1. A through-accessible reversible operation jet pump for attachment to a tubing string and providing access through a packer beneath or distal to the jet pump in a well annulus, comprising:

a pump housing having a pump housing wall defining a pump housing interior, the pump housing configured for coupling to the tubing string, the pump housing interior having a pump housing inner diameter matching a tubing string inner diameter of the tubing string;

a jet pump assembly retrievably disposed in said pump housing interior, said jet pump assembly having a proximal carriage head sealingly and slidably engaging said pump housing wall of said pump housing, at least one proximal seal between said proximal carriage head and said pump housing wall, a distal carriage head sealingly and slidably engaging said pump housing wall of said pump housing in spaced-apart relationship to said proximal carriage head, at least one middle seal and at least one distal seal between said distal carriage head and said pump housing wall, a distal carriage head bore in said distal carriage head, at least one fluid outlet opening between said at least one middle seal and said at least one distal seal and communicating with said distal carriage head bore, a carrier releasably coupled to said proximal carriage head and said distal carriage head, a carrier nozzle in said carrier and communicating with said distal carriage head bore, at least one carrier opening in said carrier and establishing communication between said carrier nozzle and said pump housing interior and an annular space unobstructed between an outer surface of said carrier and an inner surface of said pump housing wall of said pump housing;

said jet pump assembly adapted to be selectively removed from said pump housing interior through the tubing string as said pump housing remains attached to the tubing string with said pump housing interior unobstructed and having a uniform cross-sectional volume along its length when said jet pump assembly is removed from said pump housing interior;

said carrier of said jet pump assembly selectively positional in a first orientation in said pump housing interior to facilitate operation of said jet pump in a first fluid flow direction operational mode in which fluid is flowable in a first direction through said proximal carriage head, said carrier and said distal carriage head, respectively;

said carrier of said jet pump assembly selectively removable from said pump housing interior, orientable in 180 degree relationship to said first orientation and positional in a second orientation in said pump housing interior to facilitate operation of said jet pump in a second fluid flow direction operational mode opposite said first fluid flow direction operational mode and in which fluid is flowable in a second direction through said distal carriage head, said carrier and said proximal carriage head, respectively; and said well annulus accessible through said tubing string, said pump housing interior of said pump housing and said packer when said jet pump assembly is removed from said pump housing interior.

2. The through-accessible reversible operation jet pump of claim 1 further comprising at least one circumferential proximal seal groove in said proximal carriage head and wherein said at least one proximal seal is disposed in said at least one circumferential proximal seal groove, at least one circumferential middle seal groove in said distal carriage head and wherein said at least one middle seal is disposed in said at least one circumferential middle seal groove and at least one circumferential distal seal groove in said distal carriage head and wherein said at least one distal seal is disposed in said at least one circumferential distal seal groove.

3. The through-accessible reversible operation jet pump of claim 1 wherein said carrier comprises a carrier inlet end releasably coupled to either said proximal carriage head or said distal carriage head and a carrier outlet end releasably coupled to either said proximal carriage head or said distal carriage head.

4. The through-accessible reversible operation jet pump of claim 3 wherein said distal carriage head comprises at least one reservoir fluid passage communicating with said pump housing interior of said pump housing, and further comprising at least one pump housing opening in said pump housing and communicating with said at least one fluid outlet opening.

5. The through-accessible reversible operation jet pump of claim 4 wherein said distal carriage head comprises a proximal head end and a distal head end, and said at least one fluid outlet opening is disposed between said proximal head end and said distal head end.

6. The through-accessible reversible operation jet pump of claim 5 wherein said at least one reservoir fluid passage extends between and opens to said proximal head end and said distal head end.

7. The through-accessible reversible operation jet pump of claim 6 further comprising a distal carriage head neck extending from said proximal head end, and wherein said carrier is releasably coupled to said distal carriage head neck.

8. The through-accessible reversible operation jet pump of claim 1 further comprising a mixing chamber having a straight chamber segment communicating with said carrier nozzle and a diverging chamber segment communicating with said straight chamber segment.

9. A through-accessible reversible operation jet pump for attachment to a tubing string and providing access through a packer beneath or distal to the jet pump in a well annulus, comprising:

a pump housing having a pump housing wall defining a pump housing interior, the pump housing configured for coupling to the tubing string, the pump housing interior having a pump housing inner diameter matching a tubing string inner diameter of the tubing string;

a jet pump assembly retrievably disposed in said pump housing interior, said jet pump assembly including:

a proximal carriage head sealingly and slidably engaging said pump housing wall;

at least one proximal seal between said proximal carriage head and said pump housing wall;

a distal carriage head sealingly and slidably engaging said pump housing wall in spaced-apart relationship to said proximal carriage head;

at least one middle seal and at least one distal seal between said distal carriage head and said pump housing wall;

a distal carriage head bore in said distal carriage head;

at least one fluid outlet opening between said at least one middle seal and said at least one distal seal and communicating with said distal carriage head bore;

an elongated carrier having:

a carrier inlet end releasably coupled to said proximal carriage head or said distal carriage head;

a carrier outlet end releasably coupled to said proximal carriage head or said distal carriage head;

a carrier nozzle in said carrier between said carrier inlet end and said carrier outlet end, said carrier nozzle communicating with said distal carriage head bore and having a nozzle bore converging toward said carrier outlet end; and at least one carrier opening in said carrier, said at least one carrier opening establishing communication between said carrier nozzle and said pump housing interior;

an annular space unobstructed between an outer surface of said carrier and an inner surface of said pump housing wall of said pump housing;

said jet pump assembly adapted to be selectively removed from said pump housing interior through the tubing string as said pump housing remains attached to the tubing string with said pump housing interior unobstructed and having a substantially uniform cross-sectional volume along its length when said jet pump assembly is removed from said pump housing interior;

said carrier selectively positional in a first orientation in said pump housing interior to facilitate operation of said jet pump in a first fluid flow direction operational mode, with said carrier inlet end releasably coupled to said proximal carriage head and said carrier outlet end releasably coupled to said distal carriage head in said first orientation in which fluid is flowable in a first direction through said proximal carriage head, said carrier and said distal carriage head, respectively;

said carrier selectively removable from said pump housing interior, orientable in 180 degree relationship to said first orientation and positional in a second orientation in said pump housing interior to facilitate operation of said jet pump in a second fluid flow direction operational mode opposite said first fluid flow direction operational mode, with said carrier inlet end releasably coupled to said distal carriage head and said carrier outlet end releasably coupled to said proximal carriage head in said second orientation, and in which fluid is flowable in a second direction through said distal carriage head, said carrier and said proximal carriage head, respectively; and said well annulus accessible through said tubing string, said pump housing interior of said pump housing and said packer when said jet pump assembly is removed from said pump housing interior.

10. The through-accessible reversible operation jet pump of claim 9 wherein said distal carriage head comprises at least one reservoir fluid passage communicating with said pump housing interior of said pump housing, and further comprising at least one pump housing opening in said pump housing and communicating with said at least one fluid outlet opening.

11. The through-accessible reversible operation jet pump of claim 10 wherein said distal carriage head comprises a proximal head end and a distal head end, and said at least one fluid outlet opening is disposed between said proximal head end and said distal head end.

12. The through-accessible reversible operation jet pump of claim 11 wherein said at least one reservoir fluid passage extends between and opens to said proximal head end and said distal head end.

13. The through-accessible reversible operation jet pump of claim 11 further comprising a distal carriage head neck extending from said proximal head end, and wherein said carrier is releasably coupled to said distal carriage head neck.

14. A through-accessible reversible operation jet pump for attachment to a tubing string having a tubing string inner diameter and providing access through a packer beneath or distal to the jet pump in a well annulus, comprising:

a pump housing having a pump housing wall defining a pump housing interior, the pump housing configured for coupling to the tubing string and the pump housing interior having a pump housing inner diameter matching the tubing string inner diameter of the tubing string;

a jet pump assembly retrievably disposed in said pump housing interior, said jet pump assembly including:

a proximal carriage head sealingly and slidably engaging said pump housing interior, said proximal carriage head having a proximal carriage head bore;

at least one proximal seal between said proximal carriage head and said pump housing wall;

a distal carriage head sealingly and slidably engaging said pump housing interior in spaced-apart relationship to said proximal carriage head, said distal carriage head having:

a distal carriage head bore;

at least one reservoir fluid passage coextensive with said distal carriage head and communicating with said pump housing interior of said pump housing;

at least one middle seal and at least one distal seal between said distal carriage head and said pump housing wall;

a distal carriage head bore in said distal carriage head; and at least one fluid outlet opening between said at least one middle seal and said at least one distal seal and communicating with said distal carriage head bore; and an elongated carrier having:

a carrier inlet end releasably coupled to said proximal carriage head or said distal carriage head;

a carrier outlet end releasably coupled to said proximal carriage head or said distal carriage head;

a carrier nozzle in said carrier between said carrier inlet end and said carrier outlet end, said carrier nozzle having a nozzle bore communicating with said proximal carriage head bore and said distal carriage head bore and converging toward said carrier outlet end, a nozzle tip terminating said nozzle bore and a nozzle chamber communicating with said nozzle tip, said nozzle tip protruding into said nozzle chamber;

at least one carrier opening in said carrier, said at least one carrier opening establishing communication between said nozzle chamber and said pump housing interior; and a mixing chamber having a straight chamber segment communicating with said nozzle chamber and a diverging chamber segment communicating with said straight chamber segment and extending toward said carrier outlet end;

an annular space unobstructed between an outer surface of said carrier and an inner surface of said pump housing wall of said pump housing;

said jet pump assembly adapted to be selectively removed from said pump housing interior through the tubing string as said pump housing remains attached to the tubing string with said pump housing interior unobstructed and having a substantially uniform cross-sectional volume along its length when said jet pump assembly is removed from said pump housing interior;

said carrier selectively positional in a first orientation in said pump housing interior to facilitate operation of said jet pump in a first fluid flow direction operational mode, with said carrier inlet end releasably coupled to said proximal carriage head and said carrier outlet end releasably coupled to said distal carriage head in said first orientation and in which fluid is flowable in a first direction through said proximal carriage head, said carrier and said distal carriage head, respectively;

said carrier selectively removable from said pump housing interior, orientable in 180 degree relationship to said first orientation and positional in a second orientation in said pump housing interior to facilitate operation of said jet pump in a second fluid flow direction operational mode opposite said first fluid flow direction operational mode, with said carrier inlet end releasably coupled to said distal carriage head and said carrier outlet end releasably coupled to said proximal carriage head in said second orientation and in which fluid is flowable in a second direction through said distal carriage head, said carrier and said proximal carriage head, respectively; and said well annulus accessible through said tubing string, said pump housing interior of said pump housing and said packer when said jet pump assembly is removed from said pump housing interior.

15. The through-accessible reversible operation jet pump of claim 14 wherein said distal carriage head comprises a proximal head end and a distal head end and said at least one fluid outlet opening is disposed between said proximal head end and said distal head end, and further comprising at least one pump housing opening in said pump housing and communicating with said at least one fluid outlet opening.

16. The through-accessible reversible operation jet pump of claim 15 wherein said at least one reservoir fluid passage extends between and opens to said proximal head end and said distal head end.

* * * * *